United States Patent [19]

Insley

[11] Patent Number: 4,762,980

[45] Date of Patent: Aug. 9, 1988

[54] ELECTRICAL RESISTANCE FLUID HEATING APPARATUS

[75] Inventor: Harold Insley, Bridgeport, Conn.

[73] Assignee: Thermar Corporation, Trumbull, Conn.

[21] Appl. No.: 894,269

[22] Filed: Aug. 7, 1986

[51] Int. Cl.[4] ..... H05B 1/02; H05B 3/82; F24H 1/20

[52] U.S. Cl. ..... 219/307; 219/308; 219/319; 219/331; 219/381; 338/305

[58] Field of Search ..... 219/296–299, 219/301–309, 335, 336, 331, 328, 319, 316, 381, 382; 338/305

[56] References Cited

U.S. PATENT DOCUMENTS

| | | | |
|---|---|---|---|
| 1,005,754 | 10/1911 | Shoenberg . | |
| 1,122,423 | 12/1914 | Ruckle et al. | 219/306 X |
| 1,197,552 | 9/1916 | Shoenberg . | |
| 3,088,017 | 4/1963 | Schomann . | |
| 3,286,078 | 11/1966 | Hynes . | |
| 3,979,574 | 9/1976 | Rynard . | |
| 4,041,275 | 8/1977 | Gerdes . | |
| 4,185,187 | 1/1980 | Rogers . | |

FOREIGN PATENT DOCUMENTS

| | | | |
|---|---|---|---|
| 2400478 | 7/1975 | Fed. Rep. of Germany | 219/308 |
| 1345494 | 10/1963 | France | 219/335 |
| 2519536 | 7/1983 | France | 219/306 |

OTHER PUBLICATIONS

"Thermar Cuts Your Hot Water Bills In Half" Brochure 216HDSPP65, Thermar Corporation, Tankless Heater Division, Thermar Center, Trumbull, CT 06611-0398.

"Electronically Controlled Instantaneous Water Heaters", Brochure 207HJP155, Thermar Corporation, Tankless Heater Division, Thermar Center, Trumbull, CT, 06611-0398.

*Primary Examiner*—Anthony Bartis

*Attorney, Agent, or Firm*—Robin, Blecker & Daley

[57] ABSTRACT

Apparatus for electrically heating a fluid medium includes a housing (18) having an inlet channel (54) and an outlet channel (60) communicating with a central passage (62). A heating cartridge (38) is resident in the central passage (62) and has a web (90) defining first and second series connected interior channels in communication respectively with the inlet and outlet channels (54, 60). A continuous electric resistance heating coil (94) extends successively through the interior channels and includes a mechanically stressed portion (94*a*) bridging the first and second interior channels. The bridging portion (94*a*) is electrically shunted by an electrically conductive member (96) to eliminate current flow therethrough to lessen the likelihood of burnout or failure of the stressed portion (94*a*). The heating coil (94) is controlled by temperature controller (22) having a temperature sensor (20) in the central passage (62) in juxtoposition with the shunted coil portion (94*a*) to reduce or eliminate the effects of heating coil radiant energy on the temperature sensor (20). The switching unit (28) of the temperature controller (22) is supported on the housing (18) in communication with the fluid inlet channel (54) to prevent overheating of the switching unit.

15 Claims, 7 Drawing Sheets

ELECTRICAL RESISTANCE FLUID HEATING APPARATUS

FIELD OF THE INVENTION

This invention relates generally to the heating of fluid media and pertains more particularly to the electrical resistance heating of water.

BACKGROUND OF THE INVENTION

The art has long known of the practice of heating water only during flow demand periods, so to speak "continuous flow" heating, without the need for storage of heated water in tanks and the like. There is an evident efficiency in expending heating energy only at the time of demand, as contrasted with widely-used heated water reservoirs replenished with heat to maintain desired issuance temperature throughout extended non-demand periods.

One form of known continuous water heater apparatus is of the electrical resistance variety, wherein an electrical coil is arranged, with or without insulative jacket, in a housing through which cool, normal temperature water is directed on demand for heated water. Heretofore known apparatus of this type includes a control arrangement wherein alternating current power mains are switched into continuity with the electrical heating coil at zero-crossover voltage at the power mains, upon demand for heating, as sensed by a temperature sensor in the heater apparatus. Commercially known such apparatus and system is disclosed in published brochures of Thermar Corporation, Tankless Heater Division, Thermar Center, Trumbull, Connecticut 06611-0398, which are filed herewith in applicant's statement pursuant to 37 CFR 1.97 and 1.98.

Heretofore known electrical resistance heating apparatus and systems, such as the Thermar prior apparatus and other systems shown in the patents listed in the noted statement filed herein, have deficiencies in several respects, from applicant's viewpoint. Thus, such apparatus and systems previously known employ an electrical resistance heating coil which, while supported by a replacable cartridge and thereby readily replacable, experiences a relatively high rate of replacement due to burnout, attendant upon the course thereof under stress, i.e., that portion which is convoluted between the excitation power mains. More particularly, the coil is arranged in U-configuration, with its ends connected to electrodes at a common end face of the heater apparatus housing. The bottom of the U-configuration is in such return convolution and can be subjected to increased heating over the remnant unstressed courses of the coil and be more probable to burnout. Further, the radiant energy emitted by the coil has a tendency to becloud and confuse accurate temperature sensing of actual medium temperature. Additionally, switching means responsive to the temperature sensing is mounted on the apparatus housing and need be selected to have operating specifications avoiding the tendency to overheat based on the elevated temperatures of the heated medium. Need for improvement in these several respects was seen as essential by applicant, such that the industry could realize the benefits and economies of continuous flow heating apparatus and systems, above alluded to, over the constant heating demand, reservoir type, apparatus and systems presently in widespread use.

SUMMARY OF THE INVENTION

The present invention has as its primary object the provision of improved continuous flow heating apparatus and systems.

A more particular object of the present invention is the provision of electrical resistance water heating apparatus and system having improved operational characteristics over the apparatus and systems heretofore known and having the above noted disadvantages.

In efficiently attaining these and other objects, the invention provides apparatus for heating a fluid medium, comprising a housing having a fluid inlet channel and a fluid outlet channel, the housing defining a central passage opening into an exterior housing surface, a heating cartridge resident in the housing central passage and defining with the housing a pair of interior flow channels, an electrical resistance heating element supported by the cartridge interiorly of the housing in such interior flow channels, and means electrically shunting a portion of the heating element.

The shunted portion of the heating element, in the U-shaped configuration above noted, is the reversely convoluted course thereof, such shunting eliminating current flow in this stressed coil course and diminishing the likelihood of failure thereof.

Means are desirably included for sensing the temperature of fluid in the housing, and the housing preferably supports such temperature sensing means in juxtaposition with the electrical shunting means, thereby eliminating or vastly reducing the effects of coil radiant energy upon the sensing means.

Further, the invention provides for an effective derivation of cooling of elements of the associated control system from the inflow medium, as below noted.

In still another aspect, the invention provides water heater apparatus and assembly/support structure facilitating sealing and field repair thereof.

The foregoing and other objects and features of the invention will be further understood from the following detailed description of the preferred embodiment of the invention and from the drawings thereof wherein like parts and components are identified by like reference numerals throughout.

DETAILED DESCRIPTION OF THE PREFERRED EMBODIMENTS

Figure 1:
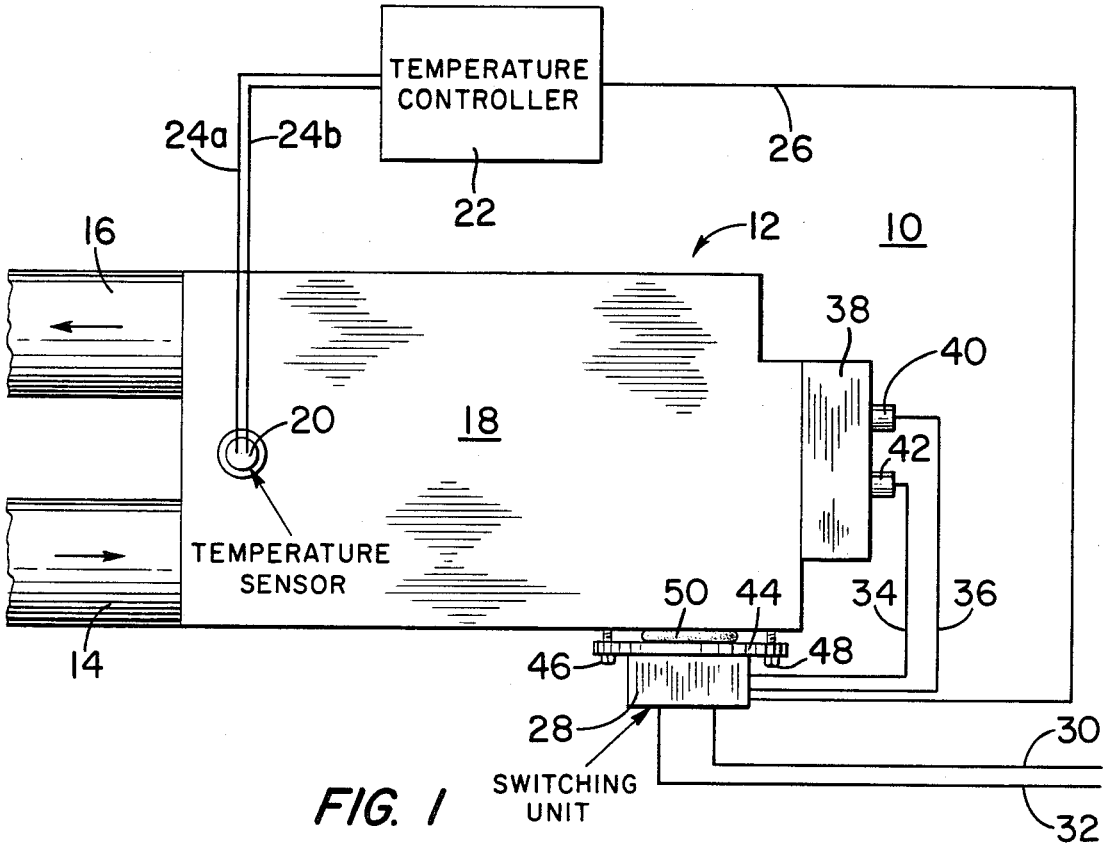
FIG. 1 is a plan view of a heater unit of the invention, shown together with electrical system connections for operating the heater unit.
Figure 2:
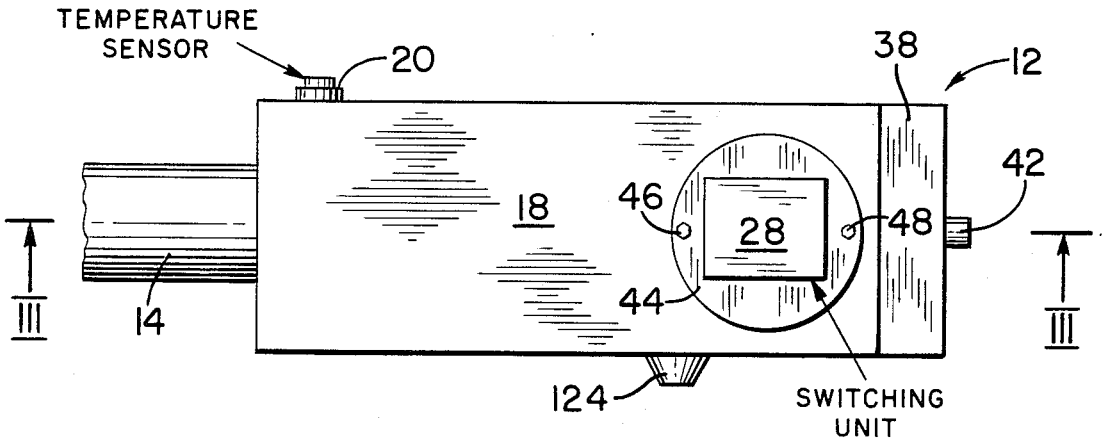
FIG. 2 is a front elevation of the heater unit of FIG. 1.

Referring to FIGS. 1 and 2, heater unit system includes heater unit 12, inlet conduit 14 and outlet conduit 16. Heater unit housing 18 is constituted throughout of plastic material and has an opening in its upper surface for receiving temperature sensor 20, which may be a thermistor in a protective casing.

Controller 22 is connected to sensor 20 by lines 24*a* and 24*b* and is thereby apprised of temperature sensed in respect of water or other medium flowing through heater unit 12. The controller furnishes its output control signal over line 26 to switching unit 28, which gates power from mains 30 and 32 to lines 34 and 36 for selective energizing of the heater unit electrical resistance heating cartridge 38 (FIG. 4), lines 34 and 36 being connected respectively to electrodes 40 and 42 of cartridge 38.

Controller 22 may be configured as the controller presently commercially available in heater unit systems HP 7024S and HP 9024S of abovementioned Thermar Corporation, to which incorporating reference is hereby made. The switching unit 28 may likewise be of the type involved in these products, i.e., switched by the controller at the zero crossovers of the single-phase line voltage on lines 30 and 32. Desired water temperature may be selected by setting an input to the controller.

Switching unit 22 is supported on heat-conductive plate 44, which is secured to housing 18 by bolts 46 and 48, a sealing member 50, e.g., an O-ring, intervenes plate 44 and housing 18 as below discussed.

Figure 3:
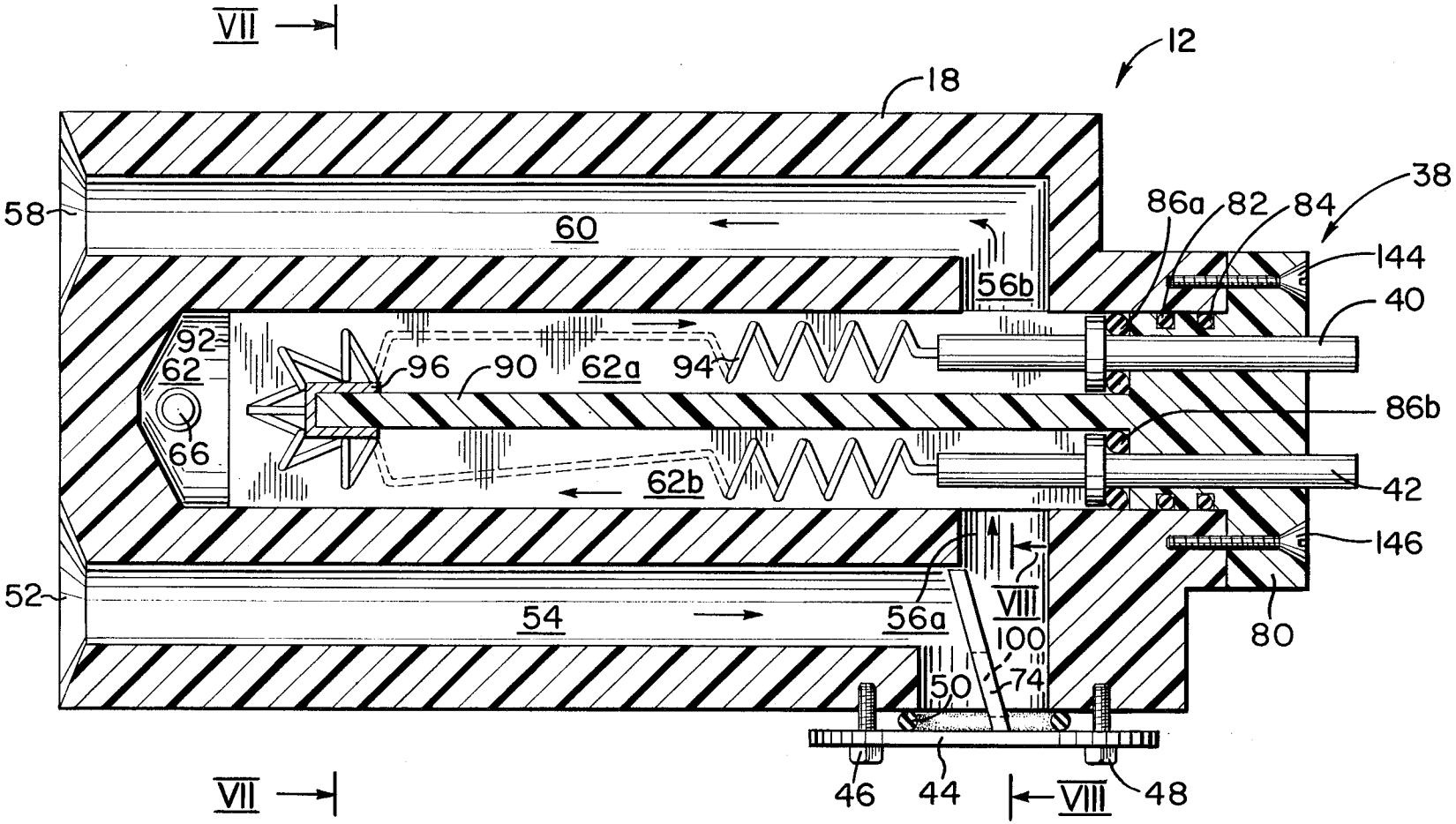
FIG. 3 is sectional view of the heater unit as would be seen from plane III—III of FIG. 2, with the heater coil and its electrodes and the diverter assembly shown in full.
Figure 4:
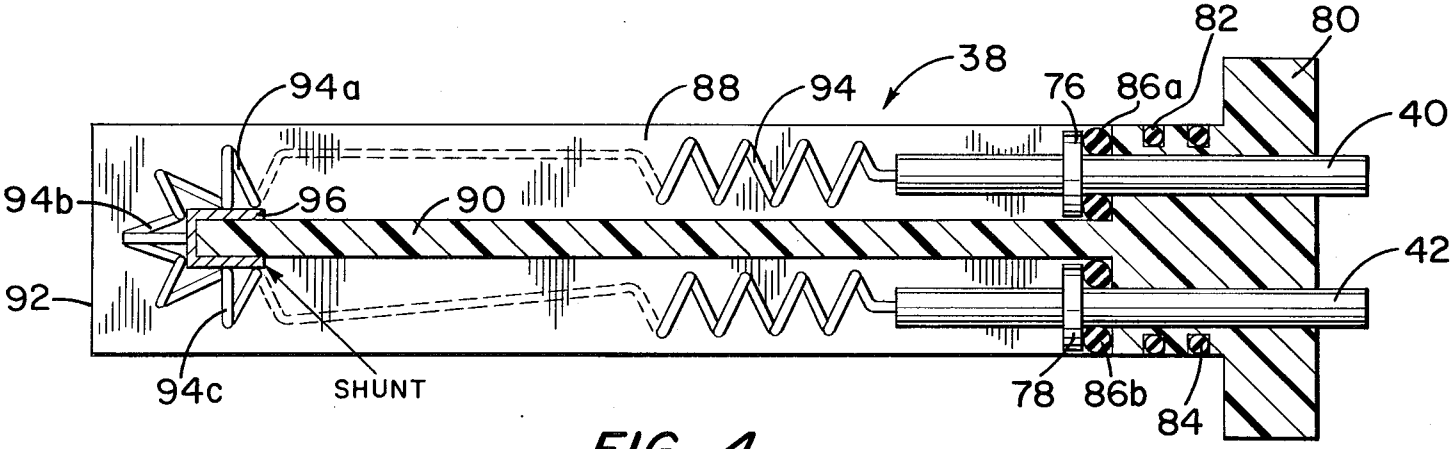
FIG. 4 is a central sectional view of the heater coil cartridge, with the heater coil and its electrodes shown in full.
Figure 5:
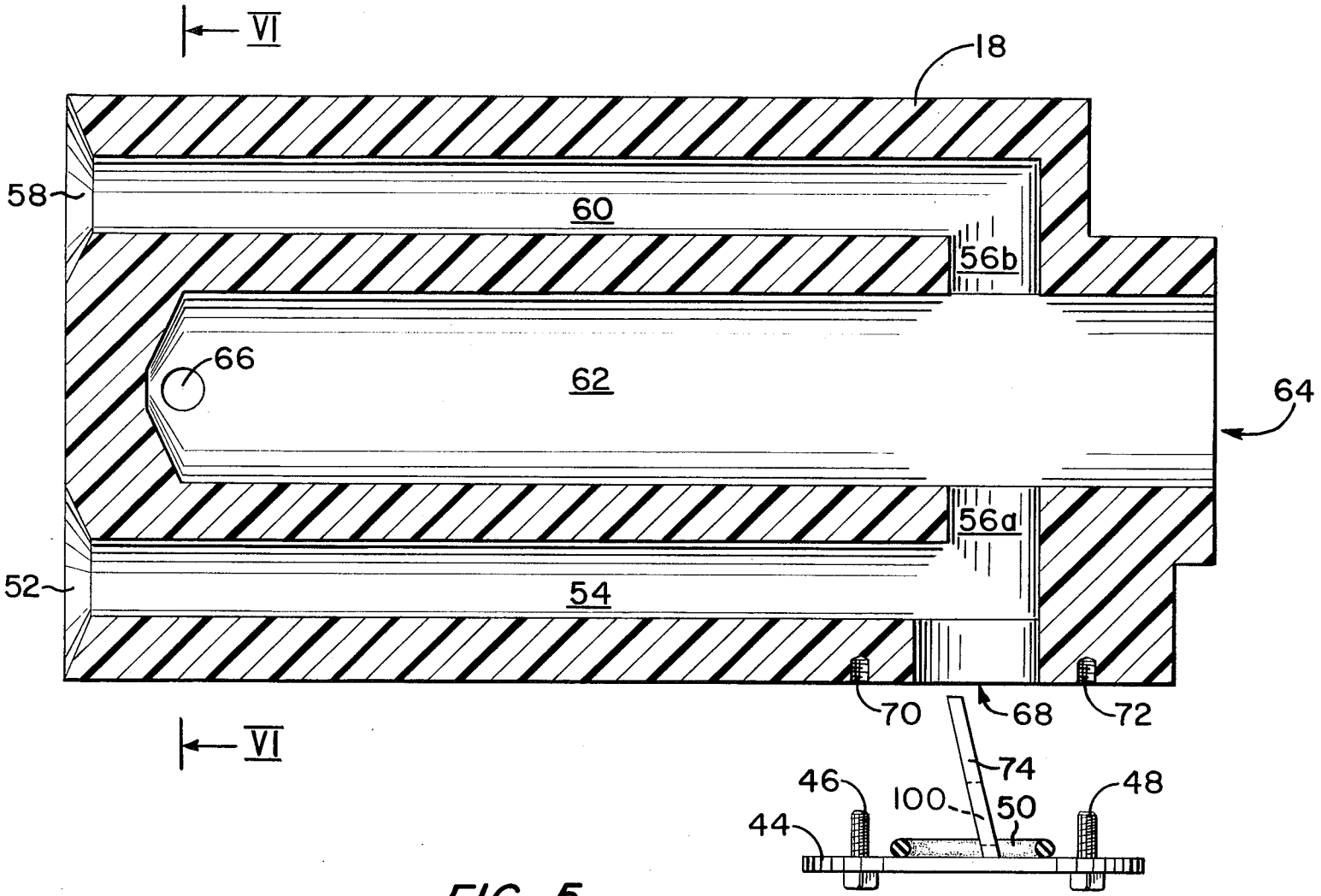
FIG. 5 is a central sectional view of the heater unit housing, with the diverter assembly shown in full and prior to securement to the housing.

Turning to FIGS. 3, 4 and 5, housing 18 will be seen to have an inlet 52, inlet channel 54, cross channels 56*a* and 56*b*, and outlet 58 and outlet channel 60. Central channel 62 has a rightward end with opening 64 and a closed leftward end, with sensor receipt opening 66.

Housing 18 has opening 68 formed in a sidewall thereof and has bolt securement passages 70 and 72 adjacent same for mounting of a flow diverter assembly, comprising the above-mentioned plate 44, bolts 46 and 48, sealing member 50 and diverter element 74, integral with plate 44 and extending therefrom as seen in FIG. 5, to extend across inlet channel 54 adjacent cross channel 56*a* upon assembly with housing 18, as seen in FIG. 3.

Cartridge 38 is fully separable from housing 18 and is shown in such independence in FIG. 4. Electrodes 40 and 42 extend lengthwise into the cartridge beyond cylindrical flanges 76 and 78 and are non-rotatively supported by cartridge head portion 80. O-rings 82 and 84 are seated in head portion recesses and O-rings 86*a* and 86*b* encircle electrodes 40 and 42 rightwardly of flanges 76 and 78. Web 90 extends lengthwise with cartridge tail portion 92 to the extent indicated in FIG. 4, i.e., spaced from the leftward end of tail portion 92. Electrical resistance heating coil 94 is an integral, single member having its ends connected respectively to electrodes 40 and 42 and is arranged in generally U-shaped configuration, bridging about the leftward end of web 90 in coil courses 94*a*, 94*b* and 94*c* inwardly of the perimeter of tail portion 92.

As noted in the above remarks concerning failure of cartridge heating coils, the bridging course of coils is highly suspect to failure, since it is under mechanical stress and is current carrying. Further, there is a tendency for such bridging coil course to melt and penetrate the web it bridges.

Figure 7:
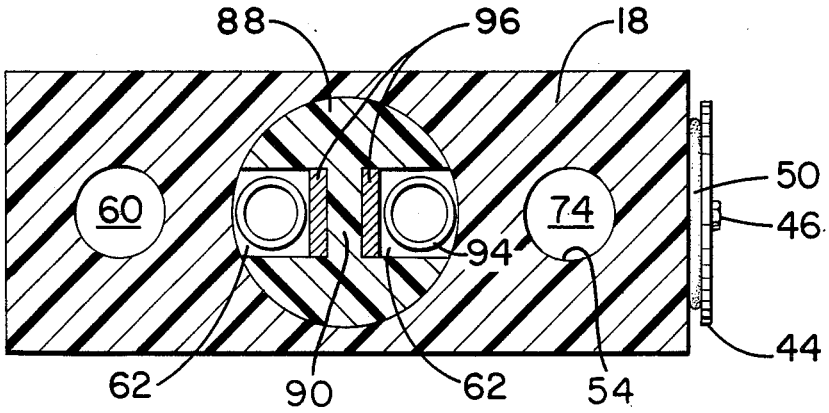
FIG. 7 is a sectional view of the heater unit as would be seen from plane VII—VII of FIG. 3.

In accordance with the invention, shunting member 96 is disposed on web 90 and intervenes the web part juxtaposed with the coil bridging portions, i.e., coil courses 94*a*, 94*b* and 94*c*. Member 96 is electrically conductive and thus shunts coil current which would otherwise be carried in these coil courses. This is seen particularly in FIG. 7, wherein the coil bridging portion is seen to be in electrical contact with member 96. Since member 96 is not under mechanical stress, being rather preformed to its relaxed configuration shown in FIG. 4, there is essentially no tendency for same to abridge the integrity of web 90.

Figure 6:
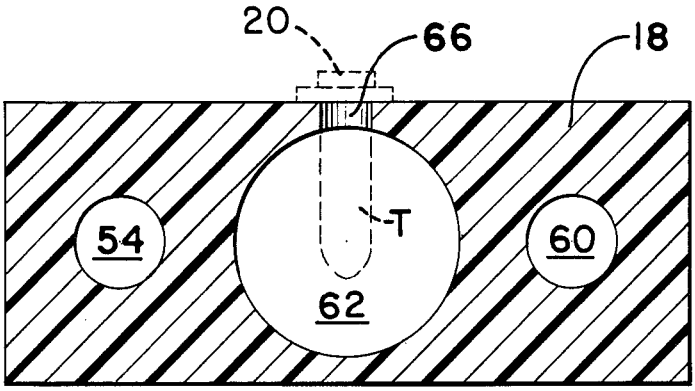
FIG. 6 is a sectional view of the heater unit housing as would be seen from plane VI—VI of FIG. 5, with the thermistor shown in place in phantom.

A further characteristic of previously known electrical resistance heater units, discussed above, is the adverse impact on temperature control due to the effects of coil radiant energy upon temperature sensors. In accordance with the invention, this impact is substantially lessened by the presence of shunting member 96, since the thermistor (T, FIG. 6) is in facing relation to the bridging, shunted coil portion, and cannot receive radiant heat therefrom, such portion not carrying current. To the extent that shunting member 96 is current carrying and may issue radiant energy, it is further spaced from the thermistor than the bridging coil portion and is of inherently less radiative nature.

Figure 8:
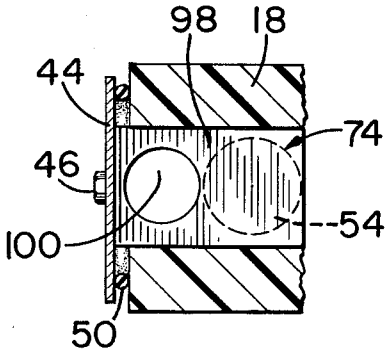
FIG. 8 is a partial sectional view of the heater unit as would be seen from plane VIII—VIII of FIG. 3.

An additional feature of the invention resides in the functioning of the aforementioned flow diverter assembly, and is seen particularly by consideration of FIGS. 3 and 8.

Flow diverter 74 includes surface expanse 98, which is unapertured and is in facing relation with inlet channel 54, and aperture 100, which is offset from inlet channel 54 and in fact outwardly thereof, toward the exterior of housing 18, adjacent plate 44. There results from this arrangement a forced direction of incoming water or other medium being heated onto the interior surface of plate 44 and continuous flow thereon, rather than a stagnant pocket of medium adjacent plate 44. It is found that, where switching unit 28 includes a triac, desirably operating at no more than thirty degrees Centrigrade, the triac operates at or about such temperature, rather than at an operating temperature of sixty degrees Centrigrade obtaining in the absence of the flow diverter assembly.

Figure 9:
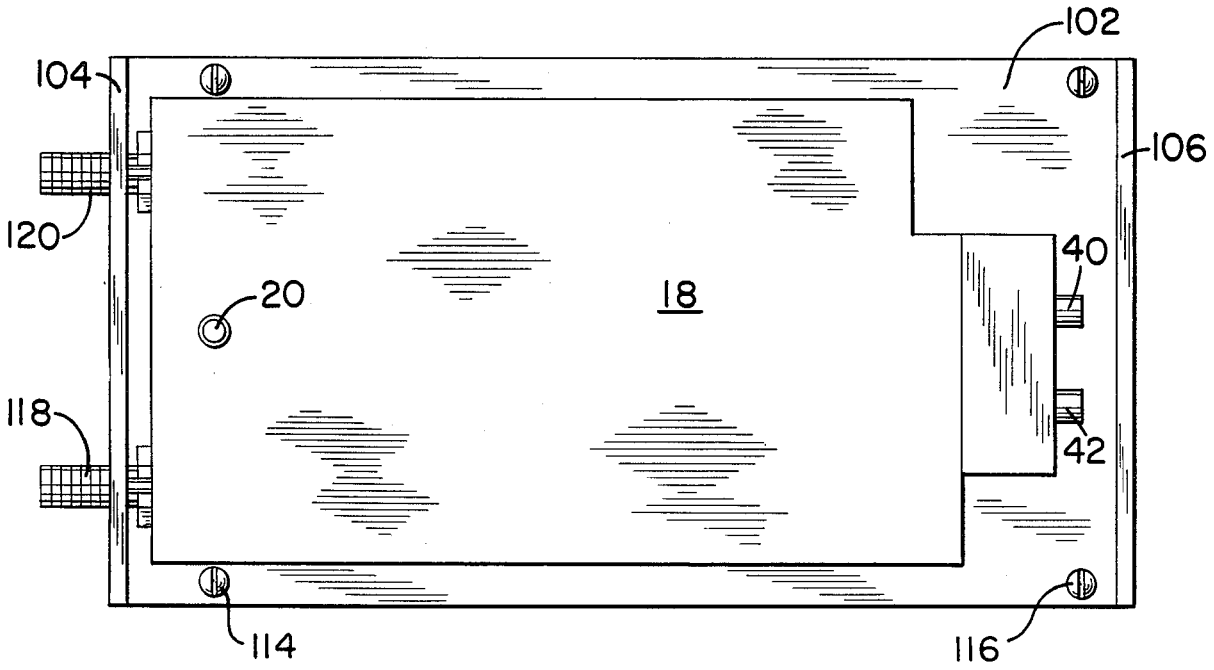
FIG. 9 is a plan view of the heater unit in association with an assembly fixture.
Figure 10:
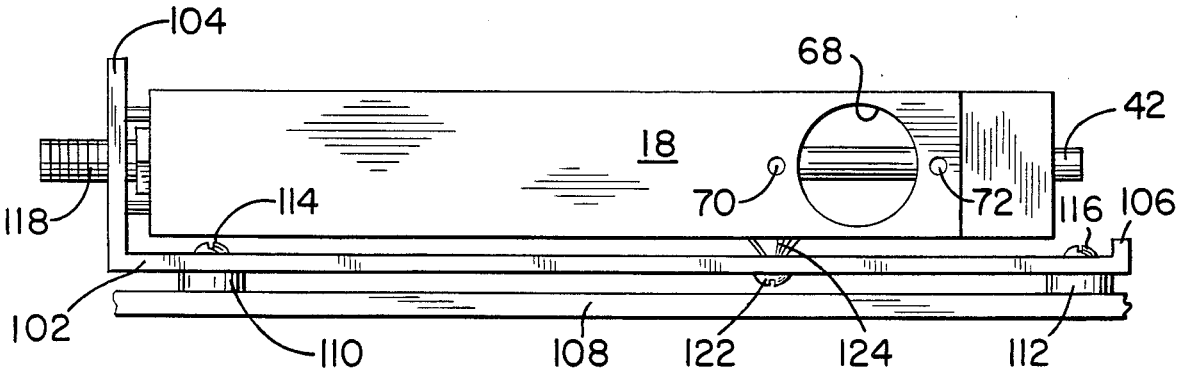
FIG. 10 is a front elevation of the FIG. 9 showing, further depicting the assembly fixture secured to a support.

Turning to FIGS. 9 and 10, assembly fixture 102 is in the form of a metallic plate having upstanding flanges 104 and 106. Fixture 102 is mountable on support 108, which may be a building panel or wall, by use of spacers 110 and 112 and screws 114 and 116.

Prior to mounting fixture 102 on support 108, housing 18 is itself assembled with inlet fitting 118 and outlet fitting 120 and the fittings are inserted in flange 104, as below discussed. Housing 18 is then secured to plate 102 by screw 122, which is received in housing leg 124.

Figure 11:
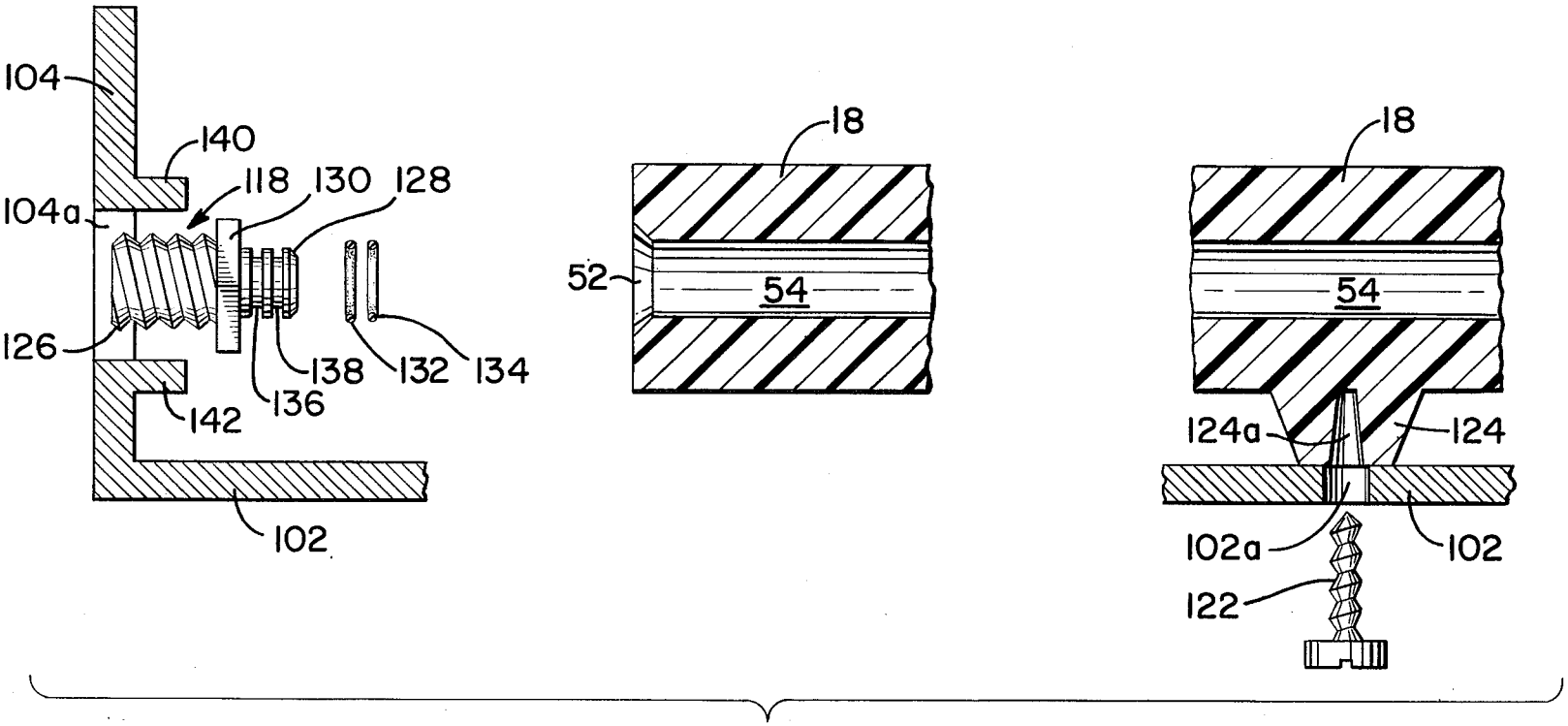
FIG. 11 is an enlarged, partial, exploded and sectional view explanatory of the assembly of FIGS. 9 and 10.

In FIG. 11, inlet fitting 118 integrally includes threaded leftward portion 126, rightward O-ring seat 128 and hexagonal nut portion 130. O-rings 132 and 134 are seated in detents 136 and 138 of seat 128 and fitting 118 is then inserted through inlet 52 into channel 54, O-rings 132 and 134 thereupon being radially compressed and sealing fitting 118 in channel 54.

Leftward portion 126 of fitting 118 is now inserted, by leftward displacement of housing 18, through opening 104*a* of flange 104 of plate 102, until locking tabs 140 and 142 abut housing 18 adjacent inlet 52. In the course of this activity, locking tabs 140 and 142 become resident atop and below nut 130, restraining same from rotation upon securement of a companion fitting (not shown) to fitting 118. The assembly of housing 18 and plate 102 is now completed by insertion of screw 122 through plate opening 102*a* into recess 124*a* of housing leg 124.

Heating cartridge 38 (FIG. 3) is releasably secured to housing 18 by screws 144 and 146 and, with flange 106 of reduced height (FIG. 10), it will be seen that cartridge 38 may be readily released from the FIG. 9 assembly without disturbing the existing mounting of the heater unit and its plumbing connections to fittings 118 and 120.

As will be see from the foregoing discussion and the drawings, the invention provides apparatus for heating a fluid medium, comprising a housing having a fluid inlet channel and a fluid outlet channel, the housing defining a central passage opening into an exterior housing surface, a heating cartridge resident in the housing central passage, an electrical resistance heating element supported by the cartridge interiorly of the housing and means electrically shunting a portion of the heating element. Means are included for sensing the temperature of fluid in the housing, the housing supporting such temperature sensing means in juxtaposition with the electrical shunting means. In a system aspect, the invention further includes control means driving switching means for selectively energizing the heating element, the housing supporting the switching means adjacent the fluid inlet channel and in fluid flow ccmmunication therewith. Flow diverter means are disposed in the fluid inlet channel for diverting fluid flowing in said fluid inlet channel onto the switching means.

In its more detailed setting, the invention provides apparatus for heating a fluid medium, comprising a housing having a fluid inlet and a fluid outlet, a fluid inlet channel and a fluid outlet channel communicating respectively with the fluid inlet and the fluid outlet, the housing defining a central passage opening into an exterior housing surface, a heating cartridge resident in the housing central passage and defining with the housing successive first and second interior channels (FIG. 3, 62*a* and 62*b*) in communication respectively with the fluid inlet channel and the fluid outlet channel, an electrical resistance heating element supported by the cartridge and extending successively through such first and second interior channels, and means electrically shunting the portion of said heating element bridging the first and second interior channels.

In more specific setting, the invention will be seen to provide apparatus for heating a fluid medium, comprising an elongate housing having a fluid inlet fitting and a fluid outlet fitting disposed on a first housing surface, a fluid inlet channel and a fluid outlet channel communicating respectively with such fluid inlet fitting and such fluid outlet fitting and extending from the first housing surface in mutual parallelism, the housing defining a generally cylindrical central passage opening into a second housing surface longitudinally opposite from the first housing surface, a generally cylindrical heating cartridge resident in the housing central passage and defining with the housing successive first and second interior channels in communication respectively with the fluid inlet channel and the fluid outlet channel and extending in mutual parallelism therewith, an electrical resistance heating element supported by the cartridge and extending successively through the first and second interior channels, and means electrically shunting the portion of said heating element bridging the first and second interior channels.

I claim:

1. Apparatus for heating a fluid medium, comprising a housing having a fluid inlet channel and a fluid outlet channel, said housing defining a central passage opening into an exterior housing surface, a heating cartridge resident in said housing central passage, an electrical resistance heating element supported by said cartridge interiorly of said housing, said heating element including a mechanically stressed portion, and means for electrically shunting said portion of said heating element to eliminate electrical current flow through said portion to lessen the likelihood of failure of said heating element.

2. The invention claimed in claim 1 further including means for sensing the temperature of fluid in said housing, said housing supporting such temperature sensing means in juxtaposition with such electrical shunting means, whereby the effect of heating element radiant energy on said temperature sensing means is lessened.

3. The invention claimed in claim 2 further including means for selectively energizing said heating element, said housing supporting such selective energizing means adjacent said fluid inlet channel and in fluid flow communication therewith.

4. The invention claimed in claim 3 further including flow diverter means in said fluid inlet channel for diverting fluid flowing in said fluid inlet channel onto said selective energizing means.

5. The invention claimed in claim 1 further including means for selectively energizing said heating element, said housing supporting such selective energizing means adjacent said fluid inlet channel and in fluid flow communication therewith.

6. The invention claimed in claim 5 further including flow diverter means in said fluid inlet channel for diverting fluid flowing in said fluid inlet channel onto said selective energizing means.

7. Apparatus for heating a fluid medium, comprising a housing having a fluid inlet and a fluid outlet, a fluid inlet channel and a fluid outlet channel communicating respectively with said fluid inlet and said fluid outlet, said housing defining a central passage opening into an exterior housing surface, a heating cartridge resident in said housing central passage and defining with said housing successive first and second interior channels in communication respectively with said fluid inlet channel and said fluid outlet channel, an electrical resistance heating element supported by said cartridge and extending successively through said first and second interior channels and having a mechanically stressed portion bridging said first and second interior channels, and means electrically shunting said portion of said heating element to eliminate electrical current flow through said portion to lessen the likelihood of failure of said heating element.

8. The invention claimed in claim 7 further including means for sensing the temperature of fluid in said housing, said housing supporting such temperature sensing means in juxtaposition with such electrical shunting means, whereby the effect of heating element radiant energy on said temperature sensing means is lessened.

9. The invention claimed in claim 8 further including means for selectively energizing said heating element, said housing supporting such selective energizing means adjacent said fluid inlet channel and in fluid flow communication therewith.

10. The invention claimed in claim 9 further including flow diverter means in said fluid inlet channel for diverting fluid blowing in said fluid inlet channel onto said control means.

11. The invention claimed in claim 7 further including means for selectively energizing said heating element, said housing supporting such selective energizing means adjacent said fluid inlet channel and in fluid flow communication therewith.

12. The invention claimed in claim 11 further including flow diverter means in said fluid inlet channel for diverting fluid flowing in said fluid inlet channel onto said selective energizing means.

13. Apparatus for heating a fluid medium, comprising an elongate housing having a fluid inlet fitting and a fluid outlet fitting disposed on a first housing surface, a fluid inlet channel and a fluid outlet channel communicating respectively with said fluid inlet fitting and said fluid outlet fitting and extending from said first housing surface in mutual parallelism, said housing defining a generally cylindrical central passage opening into a second housing surface longitudinally opposite from said first housing surface, a generally cylindrical heating cartridge resident in said housing central passage and defining with said housing successive first and second interior channels in communication respectively with said fluid inlet channel and said fluid outlet channel and extending in mutual parallelism therewith, an electrical resistance heating element supported by said cartridge and extending successively through said first and second interior channels and having a mechanically stressed portion bridging said first and second interior channels, and means electrically shunting said portion of said heating element to eliminate electrical current flow through said portion to lessen the likelihood of failure of said heating element.

14. Apparatus for heating a fluid medium, comprising a housing having a fluid inlet channel and a fluid outlet channel, said housing defining a central passage opening into an exterior housing surface, a heating cartridge resident in said housing central passage and having first and second terminals accessible at the exterior of said housing, an electrical resistance heating element supported by said cartridge interiorly of said housing and connected with said first and second terminals, said heating element including a convoluted portion distal from both said first and second terminals, and means for electrically shunting said portion of said heating element to eliminate electrical current flow through said portion to lessen the likelihood of failure of said heating element.

15. The invention claimed in claim 14 further including means for sensing the temperature of fluid in said housing, said housing supporting such temperature sensing means in juxtaposition with such electrical shunting means, whereby the effect of heating element radiant energy on said temperature sensing means is lessened.

* * * * *